US010035190B2

(12) United States Patent
Aslund

(10) Patent No.: US 10,035,190 B2
(45) **Date of Patent: *Jul. 31, 2018**

(54) MULTILEVEL PARTS FROM AGGLOMERATED SPHERICAL METAL POWDER

(71) Applicant: Metec Powder Metal AB, Karlskoga (SE)

(72) Inventor: Christer Aslund, Torshalla (SE)

(73) Assignee: Metec Powder Metal AB, Karlskoga (SE)

( * ) Notice: Subject to any disclaimer, the term of this patent is extended or adjusted under 35 U.S.C. 154(b) by 269 days.

This patent is subject to a terminal disclaimer.

(21) Appl. No.: 14/698,230

(22) Filed: Apr. 28, 2015

(65) Prior Publication Data

US 2015/0239045 A1 Aug. 27, 2015

Related U.S. Application Data

(63) Continuation of application No. 13/140,207, filed as application No. PCT/SE2010/050012 on Jan. 8, 2010, now Pat. No. 9,101,982.

(Continued)

(30) Foreign Application Priority Data

Jan. 12, 2009 (SE) ..... 0950008

(51) Int. Cl.
*B22F 3/24* (2006.01)
*B22F 3/15* (2006.01)

(Continued)

(52) U.S. Cl.
CPC ..... *B22F 3/15* (2013.01); *B22F 3/04* (2013.01); *B22F 3/087* (2013.01); *B22F 3/16* (2013.01);

(Continued)

(58) Field of Classification Search
None
See application file for complete search history.

(56) References Cited

U.S. PATENT DOCUMENTS 4,106,931 A 8/1978 Nayar
5,288,440 A 2/1994 Katagiri et al.

(Continued)

FOREIGN PATENT DOCUMENTS

EP 1 047 518 B1 3/2004
WO 2003008131 A2 1/2003

(Continued)

OTHER PUBLICATIONS

Barendvanden Bos et al., "Industrial Implementation of High Velocity Compaction for Improved Properties", Powder Metallurgy, 2006, vol. 49, No. 2, pp. 107-109, ISSN 0032-5899.

(Continued)

*Primary Examiner* — Jessee R Roe
*Assistant Examiner* — Ngoclan T Mai
(74) *Attorney, Agent, or Firm* — Renner, Otto, Boisselle & Sklar, LLP

(57) ABSTRACT

There is provided a method for the manufacture of a multilevel metal part, the method comprising the steps of: a) compacting agglomerated spherical metal powder to a green multilevel preform such that an open porosity exists, wherein the green multilevel preform fulfills the relation $z_g = z_{HVC} \cdot a$, b) debinding the green preform, c) sintering the green preform in an atmosphere comprising hydrogen d) compacting the green preform with high velocity compaction to a density of at least 95% TD, e) subjecting the part to densification to a density of at least 99 % TD. There is further provided a multilevel metal part. Advantages of the method include that it is possible to manufacture a multilevel part which is essentially uniform throughout the entire (Continued)

part and which has excellent tolerance, which at the same time has virtually full density and thereby having excellent mechanical properties as well as excellent corrosion properties.

19 Claims, 9 Drawing Sheets

Related U.S. Application Data

(60) Provisional application No. 61/144,090, filed on Jan. 12, 2009.

(51) Int. Cl.

| | |
|---|---|
| ***B22F 3/16*** | (2006.01) |
| ***B22F 3/04*** | (2006.01) |
| ***B22F 5/00*** | (2006.01) |
| ***C22C 1/04*** | (2006.01) |
| ***C22C 33/02*** | (2006.01) |
| ***C22C 38/18*** | (2006.01) |
| ***B22F 3/087*** | (2006.01) |
| *C22C 19/03* | (2006.01) |
| *C22C 19/07* | (2006.01) |

(52) U.S. Cl.

CPC ..... *B22F 3/24* (2013.01); *B22F 5/00* (2013.01); *C22C 1/0433* (2013.01); *C22C 33/02* (2013.01); *C22C 38/18* (2013.01); *B22F 2998/10* (2013.01); *B22F 2999/00* (2013.01); *C22C 19/03* (2013.01); *C22C 19/07* (2013.01); *Y10T 428/12042* (2015.01)

(56) References Cited

U.S. PATENT DOCUMENTS

| | | | |
|---|---|---|---|
| 5,427,600 | A | 6/1995 | Itoh et al. |
| 6,334,882 | B1 | 1/2002 | Ashlund |
| 6,533,836 | B2 | 3/2003 | Uenosono et al. |
| 6,656,395 | B2 | 12/2003 | Menzel |
| 7,229,263 | B2 | 6/2007 | Silbermann et al. |
| 2006/0285989 | A1 | 12/2006 | Schade |
| 2008/0202651 | A1 | 8/2008 | Uenosono et al. |

FOREIGN PATENT DOCUMENTS

| | | | |
|---|---|---|---|
| WO | 2003061882 | A1 | 7/2003 |
| WO | 2006061833 | A1 | 7/2003 |

OTHER PUBLICATIONS

International Search Report for corresponding International Application No. PCT/SE2010/050012 dated May 12, 2010.

International Preliminary Report on Patentability for corresponding International Application No. PCT/SE2010/050012 dated Jul. 12, 2011.

Fig. 1a - Conventional Art
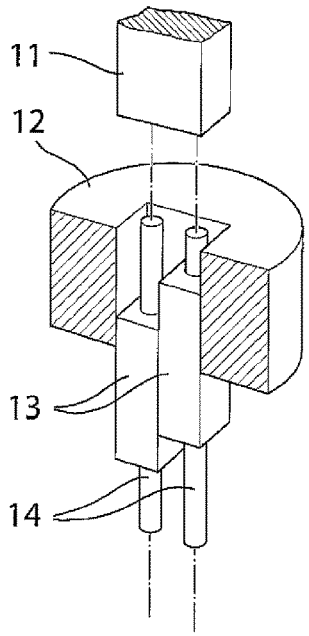
Fig. 1b - Conventional Art
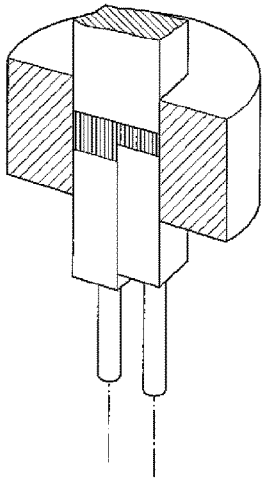
Fig. 1c - Conventional Art
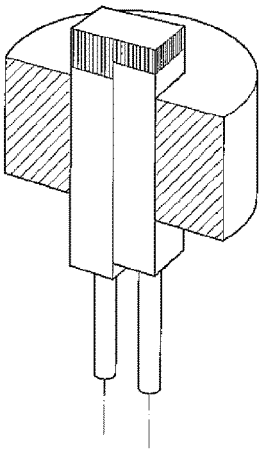

MULTILEVEL PARTS FROM AGGLOMERATED SPHERICAL METAL POWDER

This application is a continuation of U.S. application Ser. No. 13/140,207 filed on Jun. 16, 2011, now U.S. Pat. No. 9,101,982, which is a national phase application of International Application No. PCT/SE2010/050012 filed on Jan. 8, 2010 and published in the English language, which claims priority to Sweden Application No. 0950008-3 filed on Jan. 12, 2009 and to U.S. Provisional Application No. 61/144,090 filed Jan. 12, 2009.

TECHNICAL FIELD

The present invention relates generally to a method for the manufacture of multilevel metal parts from agglomerated spherical metal powder.

BACKGROUND

In the patent EP 1 047 518, it is shown that a high speed compaction (HVC) process together with an agglomerated spherical metal powder offer distinct advantages.

Bos et al in Powder Metallurgy vol 49, no 2, pp 107-109 discloses a process where the powder first is compacted traditionally and pre-sintered to burn off the lubricant. The parts are then compacted again using HVC and finally sintered traditionally. It is also stated that multilevel HVC has the potential to attract a market segment not previously feasible for PM.

WO 03/008131 discloses a process wherein in one embodiment a multilevel preform is inserted into a cavity of a tool and compacted by HVC. In another embodiment particulate material is inserted into a cavity and compacted to a preform. The pre-form is then compacted by HVC.

US 2008/0202651 discloses a method comprising the steps pre-compacting metal powder, pre-sintering the metal powder at 1000-1300° C., and compacting the pre-form by HVC.

There is plenty of room for an improvement regarding manufacture of multilevel components with HVC. This is due to the fact that the high speed of the ram makes it difficult or even impossible for the powder material to flow around in the cavity and thereby fill up all volume in a tooling die with a complicated shape such as a multilevel part. The filling of the cavity in the tool is in traditional compactions made so that a shoe is brought over the cavity, filling up the tool up to the upper level of the tool. In a conventional tooling set there are also often internal parts, see FIG. 1, which are moving up or down during the pressing operation, thereby creating the multilevel pressed part. This is in practice not possible to do during HVC or similar methods.

Another room for improvement concerns the upper limit of densification. Due to the adiabatic effect, described in the patent EP 1 047 518, it is possible to reach very high densities with HVC, way over the conventional pressing technique. However, due to the need for debinding a binder such as a hydrocolloid it is necessary to stop the densification at a certain upper limit to allow the binder to evaporate during this step.

Other undesired phenomena can also occur in the state of the art at extremely high densities with the binder incorporated such as blisters in the surface.

A further area where there is a room for improvement is the tolerances of a pressed multilevel part, which at the same time has full density and the associated desired mechanical properties.

A further problem in the state of the art is that the density of a uniaxially compressed part differs in the part, due to factors such as friction against the wall of the tool.

It is well known in the art that it so far has not been possible to use high speed compaction to compact powder materials with a grain size of less than 1 mm to multilevel parts.

SUMMARY OF THE INVENTION

One object of the present invention is to obviate at least some of the disadvantages in the prior art and provide an improved high speed compaction method for the manufacture of a multilevel metal part.

In a first aspect there is provided a method for the manufacture of a multilevel metal part, said method comprising the steps:

a. compacting agglomerated spherical metal powder to a green multilevel preform with a density such that an open porosity exists, wherein the green multilevel preform has at least two different heights in z-direction in a three dimensional Cartesian coordinate system, wherein the ratio between the highest height $z_h$ and the lowest height $z_l$ ($z_h/z_l$) is at least 1.1, wherein the green multilevel preform fulfils the relation $z_g = z_{HVC} \cdot a$, wherein $z_g$ is the variable height in z-direction for any point in the xy-plane of the green multilevel preform in the z-direction, wherein $z_{HVC}$ is the variable height in z-direction for any point in the xy-plane after high velocity compaction in step (d), and wherein a is a constant related to the compaction ratio.

b. debinding the green preform, c. sintering the green preform in an atmosphere comprising hydrogen with a dewpoint not exceeding −40° C.

d. compacting the green preform uniaxially along the z-axis with high velocity compaction to a density of at least 95% TD, e. subjecting the part to densification to a density of at least 99% TD.

In a second aspect there is provided a multilevel metal part manufactured according to the method above.

Further aspects and embodiments are defined in the appended claims, which are specifically incorporated herein by reference.

One advantage of the invention is that it is possible to manufacture a multilevel part with excellent tolerance, which at the same time has virtually full density and thereby having excellent mechanical properties.

Another advantage is that the corrosion properties are excellent.

A further advantage is that the density of a part can be made essentially uniform throughout the entire part.

BRIEF DESCRIPTION OF THE DRAWINGS

The invention is now described, by way of example, with reference to the accompanying drawings, in which:

FIGS. 1*a-c* show conventional pressing of a multilevel part. FIG. 1*a* shows the tool in filling position. Lower rams are drawn down into the die so far from its upper edge that the compression relation between powder and pressed part becomes correct. Then powder is filled into the cavity of the die. 11 denotes the upper ram, 12 denotes the die, 13 denotes the lower rams, and 14 shows the cores. FIG. 1*b* shows the tool in a pressing position. The upper and lower rams have moved towards each other in the die to the positions corresponding the final shape of the body. FIG. 1*c* shows when the part is ejected from the die. It can be seen that the part is a multilevel part.

FIG. 2*a* shows the dimensions of the final product with virtually 100% TD, FIG. 2*b* shows the dimensions after HVC with 95% TD, FIG. 2*c* shows the dimensions after the compaction step a) with 85% TD, FIG. 2*d* shows the dimensions of a mold for CIP, wherein the powder has 34% TD.

DETAILED DESCRIPTION

Figure 2A:
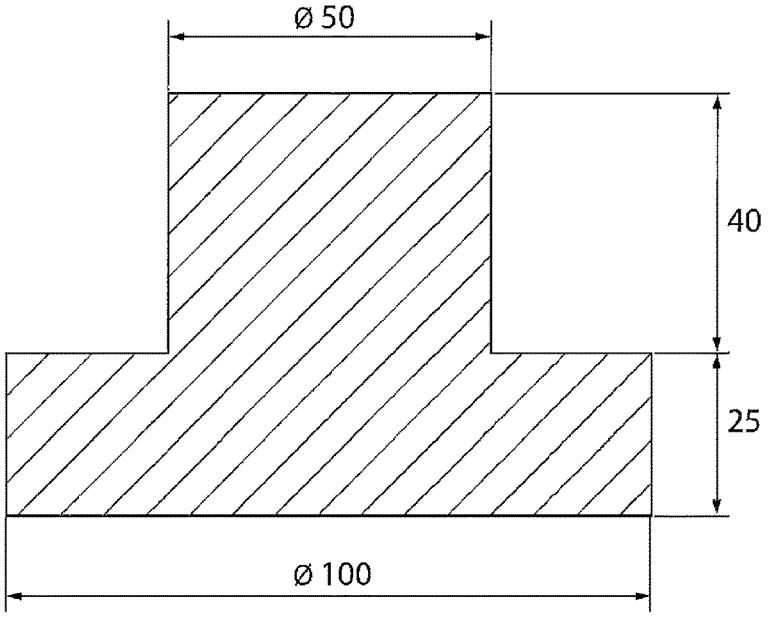
FIGS. 2*a-d* show an example of the calculations of the dimensions of a part during the different steps of the method.

Before the invention is disclosed and described in detail, it is to be understood that this invention is not limited to particular compounds, powders, configurations, method steps, substrates, and materials disclosed herein as such compounds, powders, configurations, method steps, substrates, and materials may vary somewhat. It is also to be understood that the terminology employed herein is used for the purpose of describing particular embodiments only and is not intended to be limiting since the scope of the present invention is limited only by the appended claims and equivalents thereof.

It must be noted that, as used in this specification and the appended claims, the singular forms "a", "an" and "the" include plural referents unless the context clearly dictates otherwise.

If nothing else is defined, any terms and scientific terminology used herein are intended to have the meanings commonly understood by those of skill in the art to which this invention pertains.

The term "about" as used in connection with a numerical value throughout the description and the claims denotes an interval of accuracy, familiar and acceptable to a person skilled in the art. Said interval is ±10%.

The term "cold isostatic press" is used throughout the description and the claims to denote a device in which a component normally is subjected to elevated pressure in a fluid. Pressure is applied to the component from all directions.

The term "debinding" is used throughout the description and the claims to denote the process where the green preform is heated to evaporate at least a part of the binder.

The term "density" is used throughout the description and the claims to denote the average density of a body. It is understood that some parts of the body can have a higher density that the average and that some parts of the body can have a lower density.

The term "dewpoint" is used throughout the description and the claims to denote the temperature at which $H_2O$ condensates into liquid state from a gas. In particular it is used as a measurement of the $H_2O$ content of a gas such as hydrogen.

The term "high speed steel" is used throughout the description and the claims to denote steel intended for use in high speed cutting tool applications. The term "high speed steel" encompasses molybdenum high speed steel and tungsten high speed steel.

The term "multilevel part" is used throughout the description and the claims to denote a part manufactured by uniaxial pressing with at least two different heights z along the axis in which the compression is made, and wherein the ratio between the highest height $z_h$ and the lowest height $z_l$ ($z_h/z_l$) is at least 1.1. The height of a multilevel part can be defined by an infinite number of heights in the x-y-plane.

The term "open porosity" is used throughout the description and the claims to denote a structure of void space in a part allowing percolation.

The term "sintering" is used throughout the description and the claims to denote a method comprising heating of a powder to a temperature below the melting point of the material until the particles adhere to each other.

The term "spherical metal powder" is used throughout the description and the claims to denote metal powder consisting of spherical metal particles and/or ellipsoidal metal particles.

The term "% TD" is used throughout the description and the claims to denote percentage of theoretical density. Theoretical density in this context is the maximum theoretical density for the material which the part is made of.

The term "tool steel" is used throughout the description and the claims to denote any steel used to make tools for cutting, forming or otherwise shaping a material into a part or component.

The term "uniaxial pressing" is used throughout the description and the claims to denote the compaction of powder into a rigid die by applying pressure in a single axial direction through a rigid punch or piston.

The term "$z_g$" is used throughout the description and the claims to denote the height of the green preform after the compaction in step a) of the agglomerated spherical metal powder. The height is measured in the z-direction which is the same direction in which the part is compacted during high velocity compaction. For a multilevel part the height is different at different points in the x-y-plane.

The term "$z_{Hvc}$" is used throughout the description and the claims to denote the height of the part after high velocity compaction. The height is measured in the z-direction which is the same direction in which the part is compacted during high velocity compaction. For a multilevel part the height is different at different points in the x-y-plane.

In the following, a detailed description of the invention is provided. The method for the manufacture of a multilevel metal part, comprises the steps: a. compacting agglomerated spherical metal powder to a green multilevel preform with a density such that an open porosity exists, wherein the green multilevel preform has at least two different heights in a z-direction along which it is compacted uniaxially in step d), and wherein the green multilevel preform fulfils the relation $z_g = z_{Hvc} \cdot a$, wherein $z_g$ is the variable height in z-direction for any point in the x-y-plane of the green multilevel preform in the z-direction, wherein $z_{HVC}$ is the variable height in z-direction for any point in the x-y-plane after compaction in step (d) wherein a is a constant related to the compaction ratio. b. debinding the green preform, c. sintering the green preform in an atmosphere comprising hydrogen with a dewpoint not exceeding −40° C., d. compacting the green preform uniaxially with high velocity compaction to a density of at least 95% TD, and e. subjecting the part to densification to a density of at least 99% TD.

In one embodiment the compaction in step a) is performed using cold isostatic pressing (CIP). This embodiment offers advantages including that the density in the part after step (a) is uniform, and more uniform compared to conventional uniaxial compression. By using CIP it is possible to manufacture many more geometries compared to conventional uniaxial pressing. For some geometries, for instance such which would require very elongated tools, the cost is reduced with CIP compared to conventional uniaxial pressing. Some geometries require tools where for instance the lower ram has parts that are moving in relation to each other during conventional uniaxial pressing, but such costs do not exist if CIP is used instead of conventional uniaxial pressing.

In one embodiment the pressure during the CIP is from 1000 bar to 10000 bar. In one embodiment the pressure during the CIP is from 2000 bar to 8000 bar. In another embodiment the pressure is from 2000 bar to 6000 bar. The pressure of the compaction in step a) must be adapted so that an open porosity exists after the compaction in step a).

In one embodiment the agglomerated spherical metal powder is dispensed by weight for each part. When CIP is used the powder is normally dispensed by weight for each part. It is possible to achieve further improved tolerances with CIP when the powder is dispensed per weight because exactly the correct amount of powder is provided. Compared to conventional uniaxial pressing where the powder is dispensed by filling a volume in the tool this improves the precision. When the powder is dispensed per weight the amount of binder must be considered. Essentially all of the binder is removed during the subsequent steps.

In one embodiment using CIP the tooling material is a polyurethane material, which gives the possibility to make cheap and very complicated parts by simply casting the said polyurethane.

When CIP is used for step a) the corners of the part are slightly rounded compared to for instance uniaxial pressing. During the high velocity compaction the rounded corners achieve their correct shape.

In one embodiment adjustments are made of the green preform after step a). In one embodiment indents are made in the green preform after step a).

In one embodiment the compaction in step a) is performed using a method selected from the group consisting of uniaxial pressing and cold isostatic pressing.

In one embodiment the compaction in step a) is performed with uniaxial pressing with a pressure not exceeding 1000 N/mm$^2$. In an alternative embodiment the compaction in step a) is performed with uniaxial pressing with a pressure not exceeding 600 N/mm$^2$. In a further embodiment the compaction in step a) is performed with uniaxial pressing with a pressure not exceeding 500 N/mm$^2$. In yet another embodiment the compaction in step a) is performed with uniaxial pressing with a pressure not exceeding 400 N/mm$^2$. In still a further embodiment the compaction in step a) is performed with uniaxial pressing with a pressure not exceeding 300 N/mm$^2$. The pressure of the compaction in step a) must be adapted so that an open porosity exists after the compaction in step a). Normal pressures are between 400 and 800 N/mm$^2$ due to the life length of the tool.

In one embodiment the density of the green multilevel preform in step a) does not exceed 90% TD.

The density after step a) should not be too high because substances should be allowed to evaporate during the debinding step. The spherical powder shape is in itself ideal compared to irregular powder to facilitate the removal of impurities. Thus there shall be an open structure in the compacted metal powder after step a) wherein the open structure allows the binder to evaporate during debinding. If the density becomes too high there is no longer an open porosity and the binder is unable to evaporate which may lead to undesired effects when the binder remains in the part. The properties of a part will be impaired if there are left impurities from remaining binder. In one embodiment the density after step a) is not higher than 90% TD. In another embodiment the density after step a) is not higher than 85% TD. In yet another embodiment the density after step a) is not higher than 82% TD. In an alternative embodiment the density after step a) is from 80% TD to 90% TD.

During the debinding in step b) the binder is evaporated. In one embodiment the debinding is performed at a temperature from 350° C. to 550° C.

After the debinding, the green preform is sintered. The debinding and sintering are performed by heating the part. In one embodiment the debinding with subsequent sintering is performed in one step. In one embodiment the sintering in step (c) is performed in an atmosphere comprising at least 99 wt % hydrogen. In one embodiment the sintering is performed in an atmosphere comprising at least 99.9 wt % hydrogen. In one embodiment the sintering is performed in an atmosphere comprising essentially pure hydrogen.

In one embodiment the sintering in step (c) is performed in an atmosphere comprising hydrogen and methane. In one embodiment the atmosphere comprises from 0.5 to 1.5 wt % of methane. In one embodiment the atmosphere comprises hydrogen and from 0.5 to 1.5 wt % of methane. In one embodiment the atmosphere comprises hydrogen and from 0.5 to 1.5 wt % of nitrogen.

During the sintering step (c) the amounts of carbon, nitrogen and oxygen in the metal part will be improved. Oxygen is an impurity which it is desired to remove to a sufficient extent. In one embodiment the oxygen level is lower than 500 weight-ppm after the sintering step (c). The hydrogen atmosphere will achieve suitable values of the oxygen, carbon and nitrogen impurities together with the temperature and the sintering time. Oxides of elements such as Fe and Cr are reduced in a hydrogen atmosphere provided that the temperature and the dewpoint of the hydrogen are suitable. The temperature should be sufficiently high so that the oxygen level in the part decreases. Oxides on the surface of the metal powder are formed during handling, agglomeration, debinding etc of the powder. If the temperature and dewpoint are not suitable there will be no reduction of the surface oxide and this will remain on the surface of the particles and may become a fracture later when the part is subjected to stress. The surface oxides are reduced in a hydrogen atmosphere to elemental metal and water. During the sintering the dewpoint of the hydrogen will increase during the reduction because of the water from the reaction and then it will lower again.

Most of the oxygen is in the form of extremely fine slag particles inside the metal particles and do little harm. A suitable temperature and dewpoint can be obtained from an Ellingham diagram for every specific alloy.

In one embodiment the final oxygen level is lower than 500 weight-ppm. In an alternative embodiment the final oxygen level is lower than 300 weight-ppm. In yet another embodiment the final oxygen level is lower than 200 weight-ppm. In a further embodiment the final oxygen level is lower than 100 weight-ppm. In yet a further embodiment the final oxygen level is lower than 50 weight-ppm. The sintering temperature is adapted to the material which is to be sintered keeping in mind the need for decrease in the oxygen level. Examples of temperatures for various materials in a hydrogen atmosphere with a dewpoint of −60° C. include but are not limited to about 1250° C.-1275° C. for stainless steel such as 316 L, about 1150-1200° C. for heat-treatable steels, about 1200° C. for carbon steel such as but not limited to 100Cr6, 42CrMo4, and about 1150° C. for high speed steel such as but not limited to ASP 2012®. ASP 2012® is a trademark of Erasteel and denotes a powder-metallurgy high speed steel with high bend strength. Routine experiments may be carried out to find the optimum sintering temperature for a specific alloy so that oxides are reduced below the desired value controlled by the Ellingham diagram.

Regarding the sintering time, a skilled person can in the light of this description by routine experimentation find a suitable sintering time with regard to the size of the part.

In one embodiment the high velocity compaction in step d) is performed with a ram speed exceeding 2 m/s, and in an alternative embodiment the high velocity compaction in step d) is performed with a ram speed exceeding 5 m/s. In yet another embodiment the high velocity compaction in step d) is performed with a ram speed exceeding 7 m/s. A high ram speed has the advantage of giving the material improved properties. Without wishing to be bound by any particular scientific theories the inventor believes that the metal at the boundaries between the metal particles melts to some extent during the high velocity compaction and that this gives advantageous connections between the metal particles after the high velocity compaction.

In one embodiment the green preform has a temperature of at least 200° C. immediately before the high velocity compaction in step d). In one embodiment the green preform is heated to a temperature of at least 200° C. immediately before the high velocity compaction in step d). In one embodiment the temperature of the green preform is adjusted to at least 200° C. immediately before the high velocity compaction in step d). This has the advantage of decreasing the yield strength and thereby the density can be further increased and/or the lifetime of the tool may be increased. In one embodiment the yield strength is during compaction is decreased 15-20%.

In one embodiment the densification in step (e) is performed using a method selected from the group consisting of hot isostatic pressing and sintering. In one embodiment the densification in step (e) is performed using both hot isostatic pressing and sintering. The hot isostatic pressing and/or sintering is performed under such conditions that the density becomes higher than 99% TD. In one embodiment the densification in step (e) is performed under such conditions that the density becomes as high as possible.

In one embodiment the metal powder is made of at least one metal selected from the group consisting of a stainless steel, a tool steel, a carbon steel, a high speed steel, a nickel alloy, and a cobalt alloy.

The geometry of the preform is in one embodiment calculated using the part to be manufactured as a starting point. During the last densification in step (e) the shrinkage can be estimated as $$\sqrt[3]{\frac{1}{D}}$$

wherein D is the density of the part that has been compacted with HVC in step (d). During the densification in step (e) the shrinkage is relatively small and the density is relatively high, thus the formula above can be used as a sufficiently good approximation. The shrinkage during the final sintering is approximately uniform in all directions.

When the geometry of the part after the HVC in step (d) has been calculated using the above formula, the geometry of the part before HVC in step (d) is calculated using the formula $z_g = z_{HVC} \cdot a$. The constant a is related to the uniaxial compaction ratio in step (d). Examples of typical values of a include but are not limited to from 1.09 to 1.27. The geometry of the part before HVC can be calculated using the assumption that the compression during HVC takes place essentially in the z-direction, i.e. the direction of the uniaxial compression.

In order to be able to insert the preform into the cavity of the HVC press a small space between the preform and the walls of the tool should be allowed. In one embodiment this space is about 0.3 mm. In another embodiment the space is 0.1-1.0 mm. If the powder is dispensed by weight, the correct amount of powder for the final volume is dispensed and in such an embodiment several mm can often be accepted as long as the weight is correct. It is an advantage of the method that the space between the preform and the HVC-tool can be rather large so that the insertion of the preform is simplified.

During the sintering in step (c) the shrinkage is very small because of the relatively temperature. The temperature should be held so low that essentially no shrinking occurs. In one embodiment the shrinkage during the sintering in step c) should not exceed 0.5% of the length. During the debinding virtually no shrinkage occurs.

During the compaction step a) considerable shrinkage occurs. If uniaxial pressing is used the shrinkage occurs along the axis of compression and is calculated using the % TD of the agglomerated spherical metal powder and the % TD after the initial compaction.

Figure 2B:
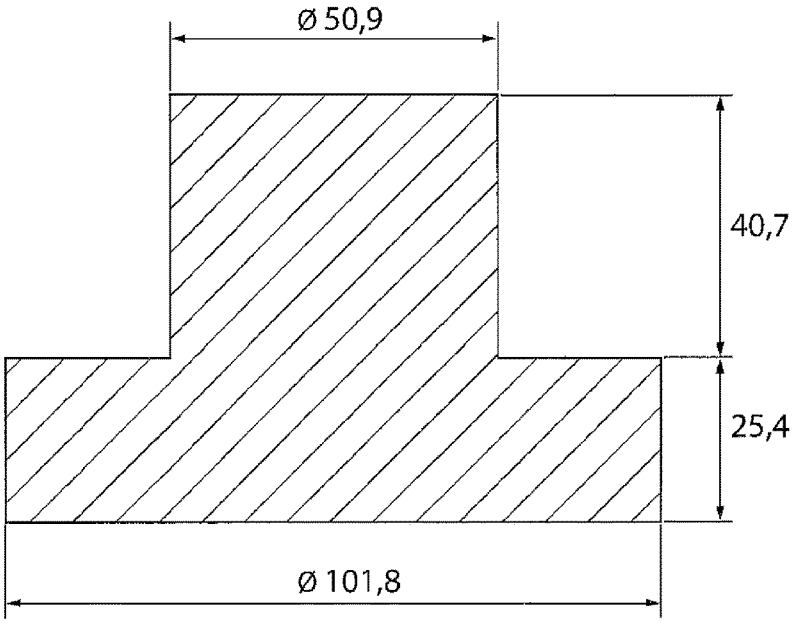
Figure 2C:
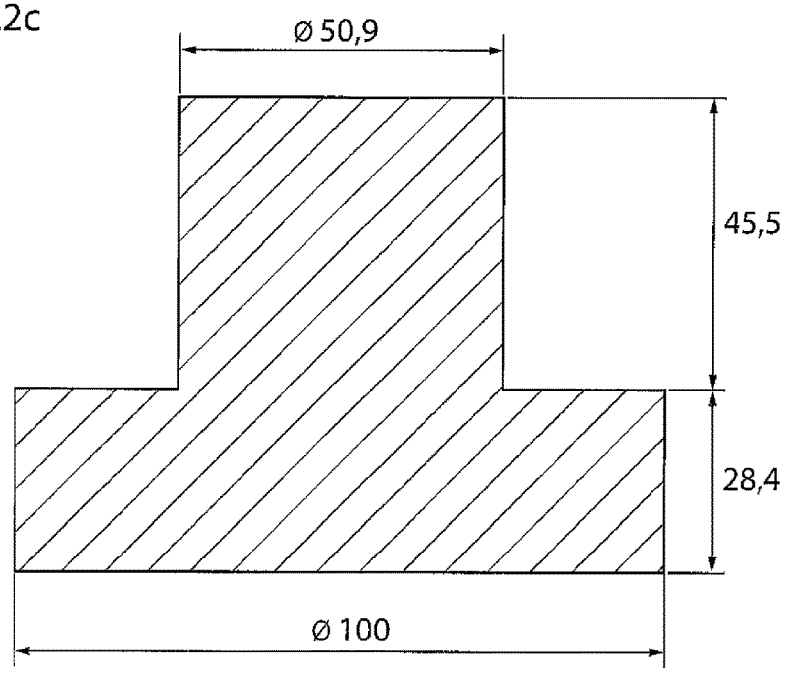

One non limiting example of a calculation of the shrinkage of a part during the process is depicted in FIG. 2*a-d*. During the calculation it can be assumed that the density of the final part corresponds to 100% TD although in practice the density may only reaches values very close to 100% TD such as for example 99.8% TD or higher. The dimensions are determined by the final part in FIG. 2*a*. The dimensions after the HVC but before the final sintering are calculated using the formula above and are shown in FIG. 2*b*. The dimensions immediately before HVC are calculated assuming compression only along the z-axis and with the formula $z_g = z_{HVC} \cdot a$, wherein a is 1.118. In FIG. 2*c* $z_g$=is 28.4 and 45.5+28.4. In FIG. 2*b* $z_{HVC}$=25.4 and 40.7+25.4. When calculating the dimensions of the part immediately before HVC one option is to make the part slightly smaller, such as 0.1-1 mm smaller in the x and y directions to make it easier to insert into the HVC tool. If CIP is used to perform the compaction in step a), the dimensions of the CIP mold are calculated assuming that the part is compressed in all directions. The compression is calculated using the density of the agglomerated spherical metal powder 34% TD.

The final tolerances are essentially given by the HVC compaction, given the shrinkage during the final densification. Thus the tolerances before the HVC compaction are not very critical as long as the preform fits into the HVC tool if only the weight of the part is the desired weight.

During the compaction with HVC in step (d) the compaction is made so that the relative compaction in the direction of the compression is equal regardless of the height of the part. Since the height of the preform is adapted according to the formula $z_g = z_{HVC} \cdot a$, the lower areas and the higher areas of the part will experience approximately the same compression, assuming the compression is roughly vertical i.e. along the z-axis. It is an advantage that the entire part experiences the desired compression.

In one embodiment the HVC tool is equipped with an ejector pin in order to eject the part after HVC compaction. If the tolerances of the parts allow the shape of the part is in one embodiment made cone shaped with the wider part towards the direction in which the part is ejected.

There is also disclosed an alternative method for the manufacture of a metal part, said method comprising the steps:

a. compacting agglomerated spherical metal powder using CIP to a preform with a density such that an open porosity exists,
b. debinding the green preform,
c. sintering the green preform in an atmosphere comprising hydrogen with a dewpoint not exceeding −40° C.
d. compacting the green preform with high velocity compaction to a density of at least 95% TD,
e. subjecting the part to densification to a density of at least 99% TD.

The above alternative method can be applied to any part and not just a multilevel part.

Also in the alternative method the agglomerated spherical metal powder is in one embodiment dispensed by weight for each part.

In one embodiment for the alternative method the density of the green multilevel preform in step a) does not exceed 90% TD.

In one embodiment for the alternative method the sintering in step c) is performed in an atmosphere comprising at least 99 wt % hydrogen. In another embodiment for the alternative method the sintering in step c) is performed in an atmosphere comprising hydrogen and methane. In a further embodiment for the alternative method the atmosphere comprises from 0.5 to 1.5 wt % of methane. In yet another embodiment for the alternative method the atmosphere comprises from 0.5 to 1.5 wt % of nitrogen.

In one embodiment for the alternative method the temperature of the green preform is adjusted to at least 200° C. immediately before the high velocity compaction in step d).

In one embodiment for the alternative method the shape of the part is cone-shaped with the wider part towards the direction in which the part is ejected.

In a second aspect there is provided a multilevel metal part manufactured according to the method described above.

In one embodiment the multilevel metal part comprises at least one metal selected from the group consisting of a stainless steel, a tool steel, a high speed steel, a nickel alloy, and a cobalt alloy.

Other features and uses of the invention and their associated advantages will be evident to a person skilled in the art upon reading the description and the examples. It is to be understood that this invention is not limited to the particular embodiments shown here.

EXAMPLES

The following examples are provided for illustrative purposes and are not intended to limit the scope of the invention since the scope of the present invention is limited only by the appended claims and equivalents thereof.

Manufacturing of Agglomerated Particles

Spherical particles were obtained by pulverization with a neutral gas of a stainless steel bath with the composition C 0.022%; Si 0.56%; Mn 1.25%; Cr 17.2%; Mo 2.1%; Ni 11.5% corresponding to AISI 316 L. A batch of these particles was prepared using a sieve, with a particle diameter not greater than 150 microns. An aqueous solution with a base of deionized water was prepared, which contained about 30% by weight of gelatin whose gelling strength is 50 blooms. The solution was heated to between 50° C. and 70° C. to completely dissolve the gelatin.

A mixture was made of 95 wt % of the tool steel particles of diameters not greater than 150 microns and 5 wt % of the aqueous gelatin solution, i.e. 1.5% by weight of gelatin. In order to wet the entire surface of the particles thorough mixing was performed.

As the solution gradually cooled, a gel was formed. Some of the water was allowed to evaporate by the blowing of air, and the mixture of pasty consistency was passed through a sieve with an approximate mesh size of 450 microns. Granules were thus obtained. The granules were dried by air, and then a second sieving stage was carried out in order to separate the granules from each other and in order to calibrate them by size by passing them through a sieve with a mesh size of 400 microns.

The dried granules consisted of agglomerated spherical metallic particles which were firmly bonded together by films of gelatin. A small fraction of granules consisted of isolated spherical metal particles coated with gelatin.

Example 1 (Comparative)

A tooling was used having a space with two diameters according to FIG. 2. The space was filled with the agglomerated powder with a filling density of 3.2 g/cm$^2$. The powder was then pressed at 600 N/mm$^2$ to a density of 84.5% of TD (theoretical density) in a standard uniaxial hydraulic press. Such a multilevel product is not possible to press in a high speed pressing machine (HVC).

Before sintering, the perform was debinded, i.e. the binder was removed by heat treating in air at 500° C. with 30 minutes holding time. Due to the removal of the binder and risk for blistering effects the heating rate was limited to 200° C. per hour.

The product was subsequently sintered in hydrogen at 1350° C. with a holding time of 1.5 hours at full temperature. The final density was 99.5% of TD, i.e. in principle full density. The mechanical values fulfilled the ASTM and EN standard values for mechanical properties for wrought steel of the same composition. Minimum values for stainless steel 316 L according to ASTM are as follows:

Elongation %: min 40

Yield strength: min 200 N/mm$^2$

Tensile strength: min 480 N/mm$^2$

Impact strength: 100 Joule longitudinal (Charpy v-notch test)

60 Joule transversal (Charpy v-notch test)

Figure 3A:
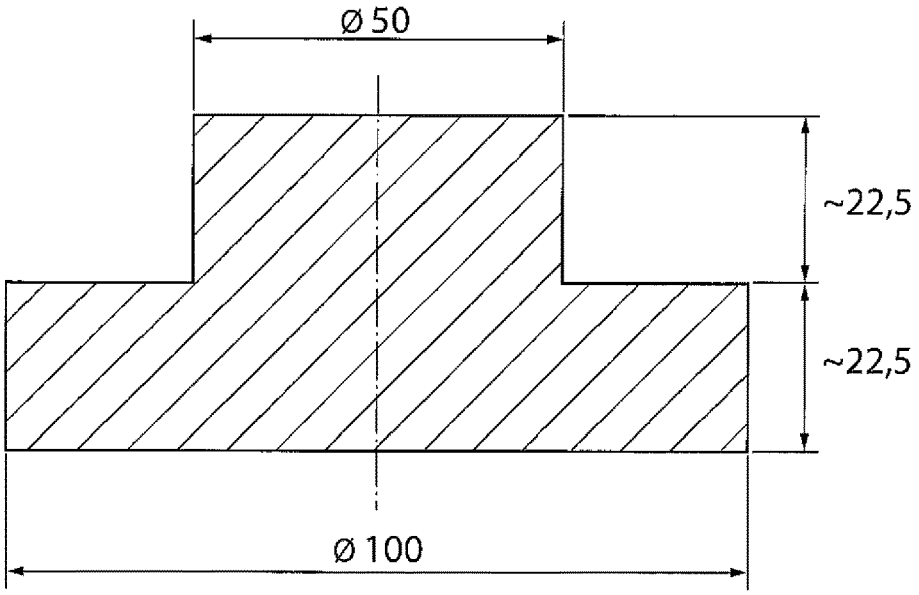
FIGS. 3*a* and *b* show the dimensions of a multilevel part at different pressing stages. See the examples for further details.

The tolerances were varying over the height, both depending of the shrinkage from 84.5 to 99.5% T.D. and the difference in compacted green density. The density was varying from top, to middle, to bottom: +2.5%, ±0%, and −2.2% respectively. The part is depicted in FIG. 3*a*.

Example 2

In the same tooling as in example 1, a similar product was made and debinded. After debinding the product was sintered at 1180° C. with a holding time of 0.5 hours. The density increased during sintering from 84.5% to 86% of T.D. After sintering the elongation was 3%. The sintered "preform" was placed in the same cavity and pressed at high speed, HVC, to a density of 95.5% of TD.

Figure 3B:
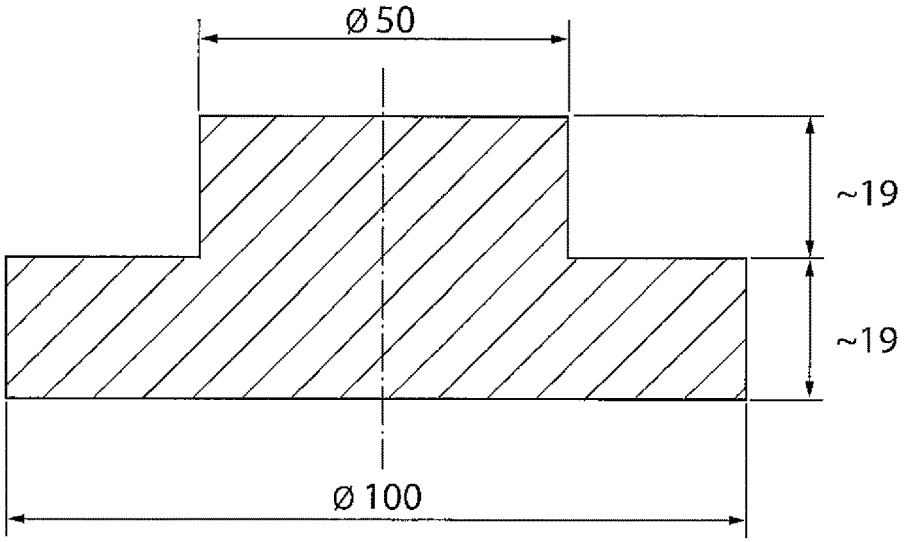
Figure 4:
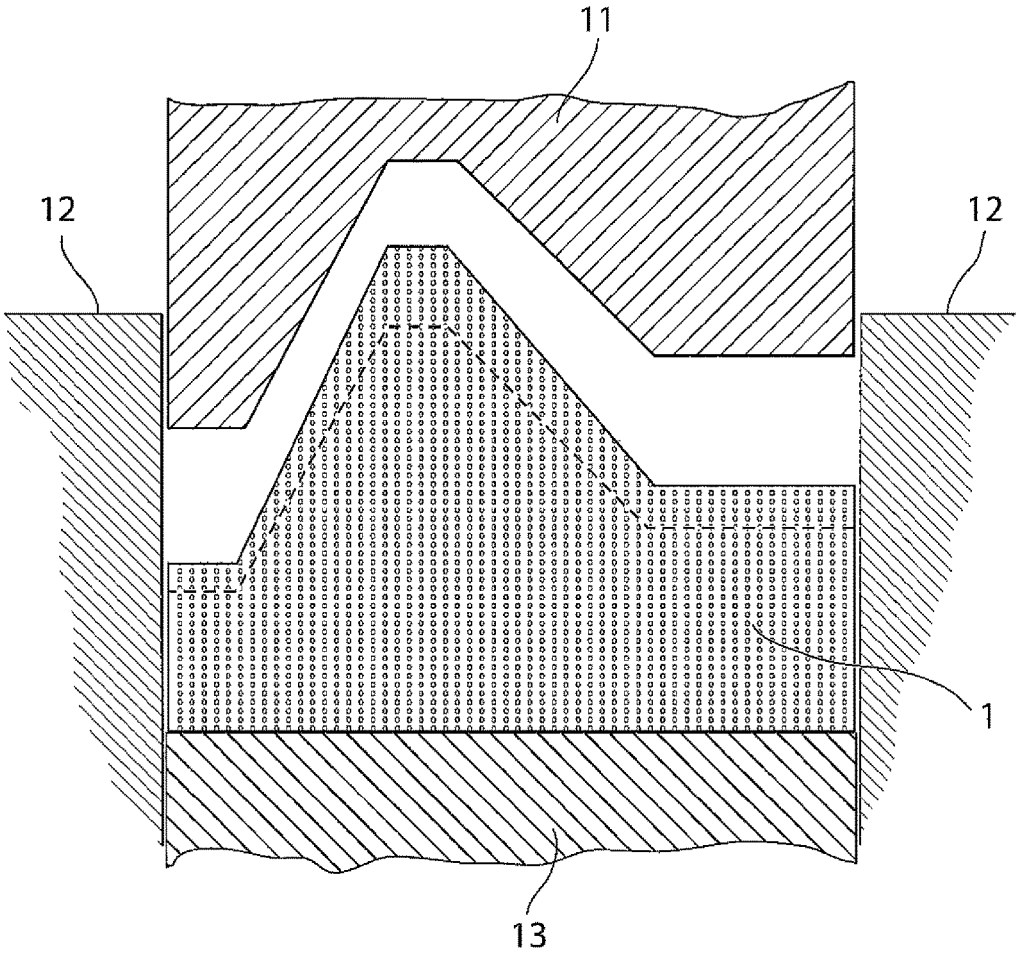
FIG. 4 shows one example of a multilevel part 1 in the tool for HVC compaction. The dashed line shows the dimensions after HVC compaction. 11 denotes the upper ram, 12 denotes the die, 13 denotes the lower ram.
Figure 5:
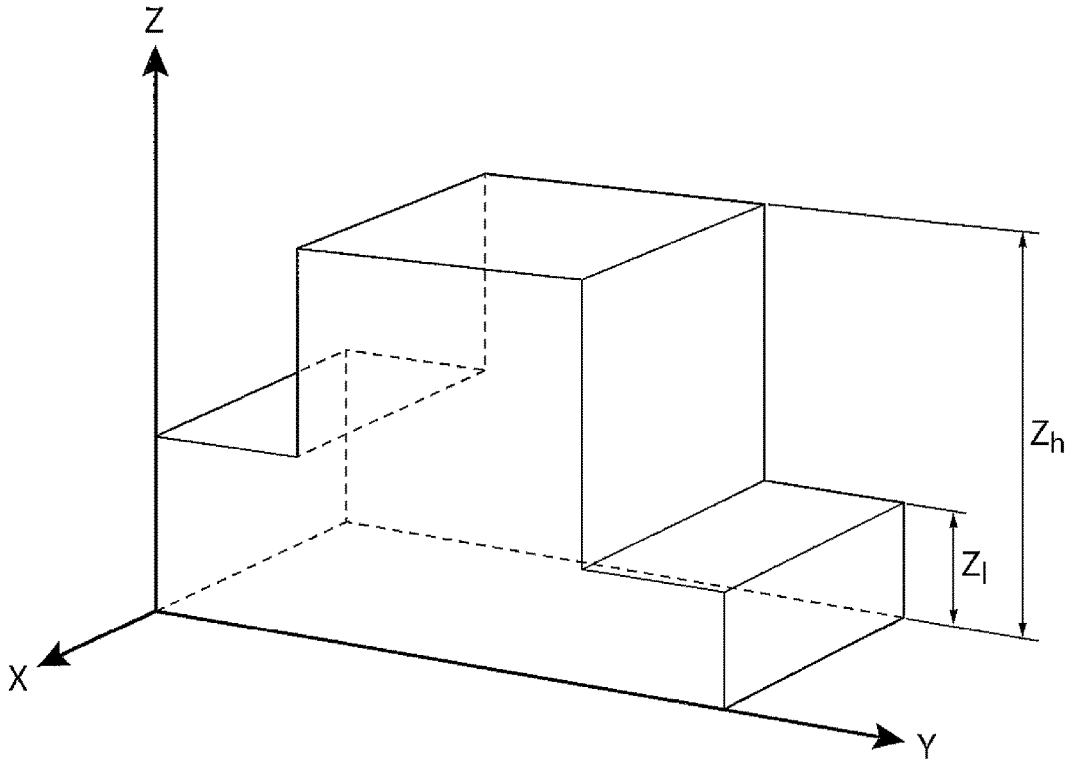
FIG. 5 shows one example of a multilevel part with a three dimensional Cartesian coordinate system. The lowest height in z direction $z_l$ and the highest height in z direction $z_h$ are shown.

The pressed part was subsequently hot isostatic pressed at 1150° C. with a holding time of 2 hours to full density (99.9% of TD). Due to the high density of the HVC-pressed perform. The tolerances were excellent, see FIG. 3*b*. the density was varying from top, to middle, to bottom: +0.2%, ±0%, and +0.15% respectively. The mechanical properties were the same as in the earlier test at full density, but with much better tolerances which is important for a multilevel component.

Example 3

In another test cold isostatic pressing was made, at a pressure of 3200 bar. The green density after step a) was 80.5% of T.D. After debinding and sintering as in example 2, the preform was HVC pressed to a density of 95.8% of T.D. and subsequently hot isostatic pressed to full density, i.e. more than 99% TD. The advantage with this operation is the low pressure at the initial pressing operation, which for instance gives a much cheaper tooling cost where polyurethane tooling is used instead of steel or cemented carbide tool due to the longer life length of the tool. One explanation for the better tolerances is the more even density of a HVC pressed body over height, but also that the perform has a very uniform density due to the cold isostatic pressing. This is a very important feature, especially for multilevel products.

Example 4

A part of stainless steel 316 L according to FIG. 2*a* was manufactured. The weight of the product is 2.18 kg. Compensating for the added binder that corresponds to 2.21 kg of added agglomerated spherical metal powder.

Figure 2D:
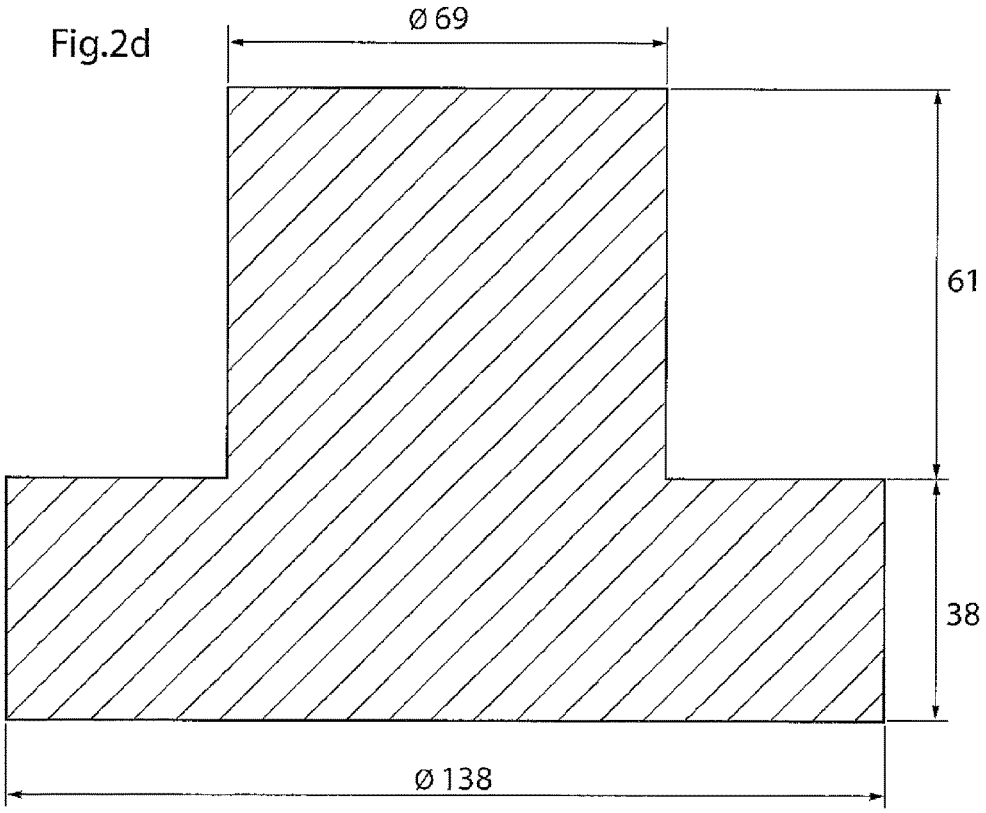

A mold was manufactured in polyurethane according to FIG. 2*d*. This form was filled with agglomerated spherical metal powder with a fill density of 2.75 g/cm$^3$. (The theoretical density TD corresponds to 7.95% TD). The mold was sealed. The mold was compressed using a cold isostatic press at room temperature at 3800 bar to a density of 84.5% TD. Because of the isostatic pressure the density becomes entirely homogenous throughout the entire part. The dimensions of the part after CIP are shown in FIG. 2*c*.

The binder in the compressed part was removed in a debinding step and subsequently the part was sintered at 1275° C. in pure hydrogen for 1 hour. The density was measured and found to be 85.3% TD i.e. almost unchanged density during the sintering step. An analysis with respect to oxygen gave that the oxygen content was 125 weight-ppm after the sintering in step c). The oxygen level of the stainless steel was initially 136 weight-ppm.

Thereafter the part was compacted by high velocity compaction in a high velocity press of the type Hydropulsor 35-18 to a density of 95.7% TD. The energy of the compression was 14800 Nm.

Subsequently a compaction was made in a hot isostatic press from Avure at a pressure of 1400 bar at 1150° C. The density after the compaction was virtually 100% TD measured by utilizing Archimedes principle. A Charpy v-notch test was performed and gave a value of 152 Joule.

The part was measured and had the following dimensions and tolerances, see also FIG. 2*a:*

Diameter 1: 100 mm+0.25 mm-0.15 mm

Diameter 2: 50 mm+0.30 mm-0.10 mm

Total height in z-direction: 65 mm+0.40 mm-0.20 mm

The results are satisfactory.

Example 5

The same part as in example 4 was manufactured. The compression step a) was performed by uniaxial pressing. The pressure was 650 N/mm$^2$. The density after the initial compaction was measured and found to be 86.5% TD.

The part was debinded and sintered as described in example 4. The density was measured and found to be 87% TD.

The part was compacted using high velocity compaction as described in example 4. The density was measured and found to be 95.2% TD.

The part was compacted using hot isostatic pressing as described in example 4. The density was measured and found to be virtually 100% TD.

The part was measured and had the following dimensions and tolerances, see also FIG. 2*a:*

Diameter 1: 100 mm+0.95 mm-1.2 mm

Diameter 2: 50 mm+0.75 mm-0.76 mm

Total height in z-direction: 65 mm+1.5 mm-1.2 mm

The mechanical properties of the different parts from example 4 and example 5 were measured:

| | Elongation % | Tensile strength N/mm$^2$ | Ultimate strength N/mm$^2$ |
|---|---|---|---|
| Example 4 | 52 | 210 | 530 |
| Example 5 | 51 | 215 | 545 |

In practice there is no difference between the two samples.

Example 6 (Comparative)

Figure 6:
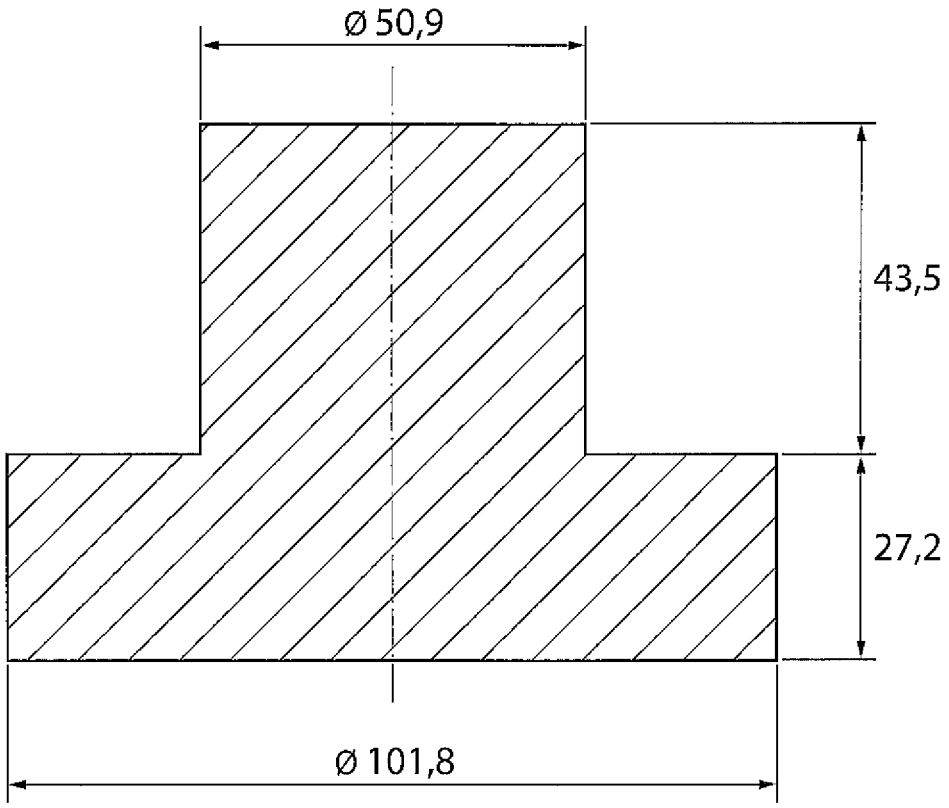
FIG. 6 shows one example of a multilevel part after uniaxial pressing, see example 6 for further details.
Figure 7A:
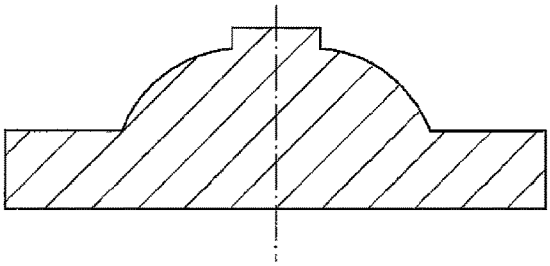
FIG. 7*a-f* show examples of products which can be made according to the present invention.
Figure 7B:
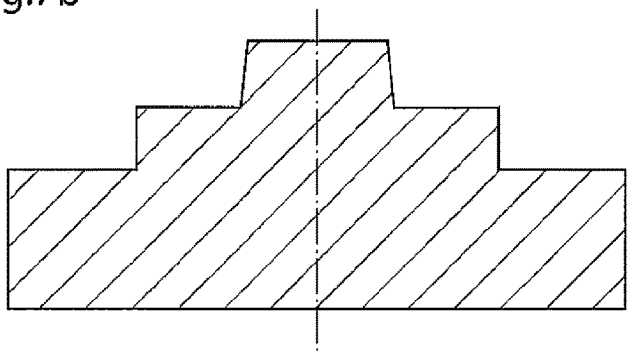
Figure 7C:
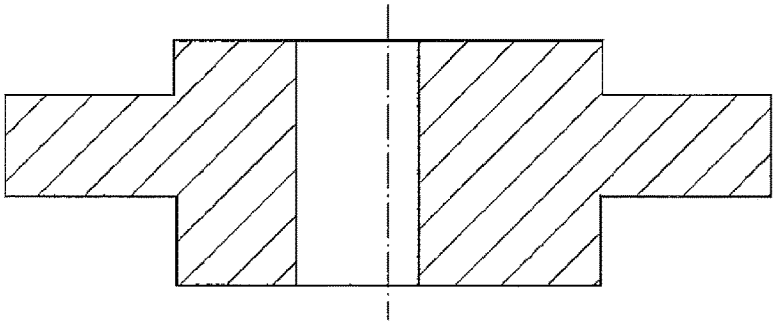
Figure 7D:
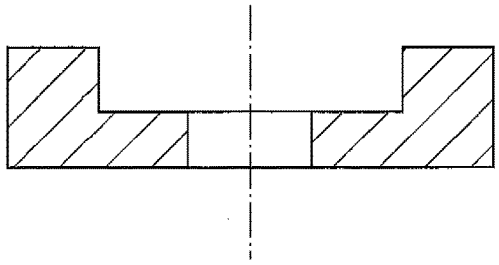
Figure 7E:
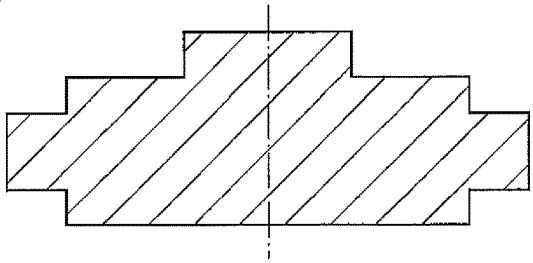
Figure 7F:
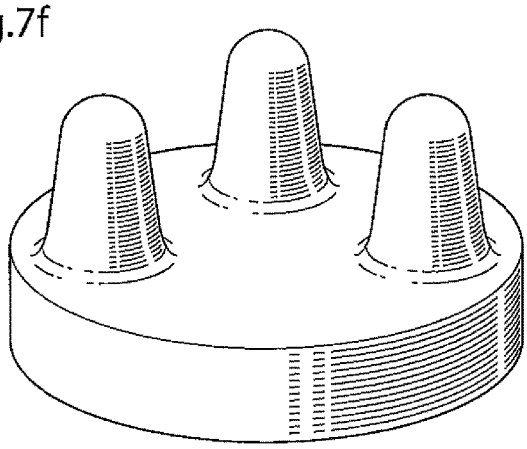

A part was manufactured by uniaxial pressing of agglomerated spherical metal powder of stainless steel 316 L. The compression was performed at a pressure of 800 N/mm$^2$. This is an accepted maximum value for industrial production of parts with uniaxial pressing. The average density after compression was measured and was found to be 89.5% TD. The dimensions after uniaxial pressing are shown in FIG. 6.

The part was sintered at 1385° C. for 1 hour in hydrogen. The density was measured and found to be 98.7% TD. The part was sintered once again at 1385° C. for 2.5 hours in hydrogen. The density was measured and found to be 98.9% TD i.e. almost unchanged. The density was always measured according to Archimedes.

Analysis sample showed that there were pores in the center of the part. A mechanical test gave the following results:

| | Elongation % | Tensile strength N/mm$^2$ | Ultimate strength N/mm$^2$ |
|---|---|---|---|
| Example 6 | 42 | 195 | 460 |

The part does not fulfill the EN-norm for stainless steel 316 L for tensile strength and ultimate strength. The part displayed concavenesses and the variation in height was at certain areas up to 2 mm. The part is not acceptable, neither regarding strength nor dimensions.

Example 7

A part was manufactured as in example 4. After debinding the part was sintered in hydrogen at 1150° C. An analysis with respect to oxygen gave that the oxygen content was 690 weight-ppm after the sintering in step c). Thereafter the part was processed as in example 4. When the part was ready another oxygen analysis was performed and it was found that the oxygen content was 650 weight-ppm.

A Charpy v-notch test was performed and gave a value of 92 Joule. A conventionally manufactured material of the same quality has according to EN-norm a minimum value of 100 Joule for longitudinal samples and 60 Joule for transverse samples. In a material mate of powder the values are equal in all direction because of the isotropy.

The invention claimed is:

1. A method for the manufacture of a multilevel metal part, said method comprising the steps:

a. compacting agglomerated spherical metal powder to a green multilevel preform with a density such that an open porosity exists, the agglomerated spherical metal powder comprising a binder, wherein the green multilevel preform has at least two different heights in z-direction in a three dimensional Cartesian coordinate system, wherein the ratio between the highest height $z_h$ and the lowest height $z_l$ ($z_h/z_l$) is at least 1.1, wherein the green multilevel preform fulfils the relation $$z_g = z_{HVA} \cdot a,$$

for all points in the xy-plane, wherein $z_g$ is the variable height in z-direction of the green multilevel preform, wherein $z_{HVC}$ is the variable height in z-direction of the part after high velocity compaction in step (d), and wherein a is a constant related to the compaction ratio, b. debinding the green preform, c. sintering the green preform in an atmosphere comprising hydrogen with a dewpoint not exceeding −40° C., d. compacting the sintered preform uniaxially along the z-axis with high velocity compaction to a density of at least 95% TD using a punch with a fixed shape, and e. subjecting the part to densification to a density of at least 99% TD.

2. The method according to claim 1, wherein the compaction in step a) is performed using a method selected from the group consisting of uniaxial pressing, and cold isostatic pressing.

3. The method according to claim 2, wherein the compaction in step a) is performed using cold isostatic pressing.

4. The method according to claim 3, wherein the agglomerated spherical metal powder is dispensed by weight for each part.

5. The method according to claim 1, wherein the compaction in step a) is performed with a pressure not exceeding 1000 N/mm$^2$.

6. The method according to claim 1, wherein the compaction in step a) is performed with a pressure not exceeding 600 N/mm$^2$.

7. The method according to claim 1, wherein the density of the green multilevel preform in step a) does not exceed 90% TD.

8. The method according to claim 1, wherein the sintering in step c) is performed in an atmosphere comprising at least 99 wt % hydrogen.

9. The method according to claim 1, wherein the sintering in step c) is performed in an atmosphere comprising hydrogen and methane.

10. The method according to claim 8, wherein the atmosphere comprises from 0.5 to 1.5 wt % of methane.

11. The method according to claim 1, wherein the atmosphere comprises from 0.5 to 1.5 wt % of nitrogen.

12. The method according to claim 1, wherein the high velocity compaction in step d) is performed with a ram speed exceeding 2 m/s.

13. The method according to claim 1, wherein the high velocity compaction in step d) is performed with a ram speed exceeding 5 m/s.

14. The method according to claim 1, wherein the temperature of the sintered preform is adjusted to at least 200° C. immediately before the high velocity compaction in step d).

15. The method according to claim 1, wherein the densification in step e) is performed using a method selected from the group consisting of hot isostatic pressing and sintering.

16. The method according to claim 1, wherein the densification in step e) is performed using hot isostatic pressing.

17. The method according to claim 1, wherein the densification in step e) is performed using sintering.

18. The method according to claim 1, wherein said metal powder comprises at least one metal selected from the group consisting of a stainless steel, a carbon steel, a tool steel, a high speed steel, a nickel alloy, and a cobalt alloy.

19. The method according to claim 1, wherein the shape of the part is cone-shaped with the wider part towards the direction in which the part is ejected.

* * * * *